US009709291B2

(12) United States Patent
Dostmann

(10) Patent No.: US 9,709,291 B2
(45) Date of Patent: Jul. 18, 2017

(54) HUMIDITY MONITORING AND ADJUSTMENT SYSTEM

(71) Applicant: La Crosse Technology, Ltd., La Crosse, WI (US)

(72) Inventor: Axel Dostmann, Wertheim (DE)

(73) Assignee: La Crosse Technology, Ltd., La Crosse, WI (US)

( * ) Notice: Subject to any disclaimer, the term of this patent is extended or adjusted under 35 U.S.C. 154(b) by 445 days.

(21) Appl. No.: 13/738,501

(22) Filed: Jan. 10, 2013

(65) Prior Publication Data

US 2013/0233933 A1 Sep. 12, 2013

Related U.S. Application Data

(60) Provisional application No. 61/585,049, filed on Jan. 10, 2012.

(51) Int. Cl.
*F24F 7/00* (2006.01)
*F24F 11/00* (2006.01)

(52) U.S. Cl.
CPC ..... *F24F 11/0015* (2013.01); *F24F 11/001* (2013.01); *F24F 11/0086* (2013.01); *F24F 2011/0091* (2013.01)

(58) Field of Classification Search
CPC .. F24F 11/0015; F24F 11/001; F24F 11/0086; F24F 2011/0091
USPC ..... 236/49.3
See application file for complete search history.

(56) References Cited

U.S. PATENT DOCUMENTS

| | | | | |
|---|---|---|---|---|
| 5,226,256 | A * | 7/1993 | Fries et al. | 49/13 |
| 2004/0182094 | A1* | 9/2004 | Menager et al. | 62/176.5 |
| 2006/0086112 | A1* | 4/2006 | Bloemer et al. | 62/176.6 |
| 2008/0029611 | A1* | 2/2008 | Schnell et al. | 236/44 |
| 2008/0134098 | A1* | 6/2008 | Hoglund | F24F 11/0012 715/841 |

(Continued)

FOREIGN PATENT DOCUMENTS

| | | | |
|---|---|---|---|
| CN | 201041397 Y | * | 3/2008 |
| CN | 201096391 Y | * | 8/2008 |
| CN | 201574656 U | * | 9/2010 |

OTHER PUBLICATIONS

Chen, Air-Conditioning Device, Mar. 26, 2008, CN201041397Y, Whole Document.*

(Continued)

*Primary Examiner* — Larry Furdge
(74) *Attorney, Agent, or Firm* — Banner & Witcoff, Ltd.

(57) ABSTRACT

Methods and systems for humidity monitoring and adjustment are described herein. Data from at least one external sensor system is received by a computing device. The external sensor system determines at least one of outdoor air temperature and outdoor air humidity. Data from at least one internal sensor system is received by the computing device. The internal sensor system determines at least one of indoor air temperature and indoor air humidity. A dew point for an indoor environment is calculated based upon the data from the external sensor system and data from the internal sensor system. A graphical indication of an indoor environment climate may be displayed based upon the calculated dew point. Access openings, such as windows, may be opened or closed to change the humidity of the indoor environment.

20 Claims, 9 Drawing Sheets

(56) References Cited

U.S. PATENT DOCUMENTS

| | | | | |
|---|---|---|---|---|
| 2009/0130966 | A1* | 5/2009 | Tucker | 454/75 |
| 2010/0107072 | A1* | 4/2010 | Mirza | F24F 11/0008 715/702 |

OTHER PUBLICATIONS

Sun, Control Device for Controlling Air Conditioner Switch-on and off and Simultaneously Controlling Sash Ventilation, Aug. 6, 2008, CN201096391Y, Whole Document.*

Yu, Automatic Induction Open-Close Window, Sep. 8, 2010, CN201574656U, Whole Document.*

* cited by examiner

800

900

HUMIDITY MONITORING AND ADJUSTMENT SYSTEM

CROSS REFERENCE TO RELATED APPLICATION

This application claims priority under 35 U.S.C. §119(e) to Provisional Application No. 61/585,049, filed Jan. 10, 2012, the disclosure of which is hereby incorporated by reference in its entirety.

FIELD OF THE TECHNOLOGY

The present disclosure is generally directed to monitoring and adjustment devices. More particularly, aspects of the disclosure pertain to humidity monitoring and adjustment systems for receiving data from external and internal sensors, calculating differences, and displaying recommendations for adjusting access openings in a user interface.

BACKGROUND

Individuals want more control over the indoor climate of their homes. In addition, individuals want system and methods that allow for automatic configuration of such. A need exists for systems and methods for humidity monitoring and adjustment.

SUMMARY

Methods and systems for humidity monitoring and adjustment are described herein. Data from at least one external sensor system is received by a computing device. The external sensor system determines at least one of outdoor air temperature and outdoor air humidity. Data from at least one internal sensor system is received by the computing device. The internal sensor system determines at least one of indoor air temperature and indoor air humidity. A dew point for an indoor environment is calculated based upon the data from the external sensor system and data from the internal sensor system. A graphical indication of an indoor environment climate may be displayed based upon the calculated dew point. Access openings, such as windows, may be opened or closed to change the humidity of the indoor environment.

BRIEF DESCRIPTION OF THE DRAWINGS

A more complete understanding of the present disclosure and the advantages thereof may be acquired by referring to the following description in consideration of the accompanying drawings, in which like reference numbers indicate like features, and wherein.

DETAILED DESCRIPTION

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

Figure 1:
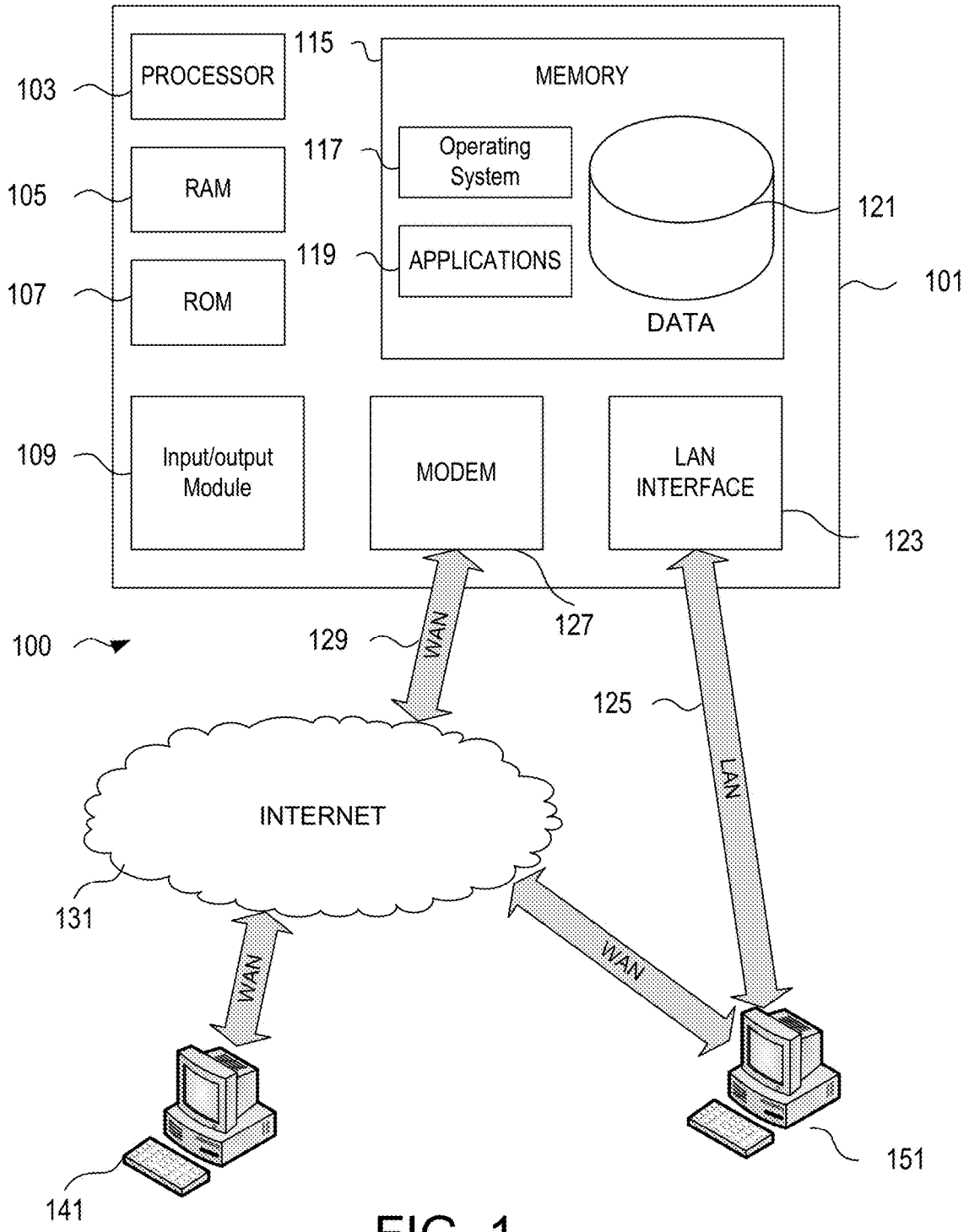
FIG. 1 illustrates a schematic diagram of a general-purpose digital computing environment in which certain aspects of the present disclosure may be implemented.

FIG. 1 illustrates a block diagram of a generic computing device 101 (e.g., a computer server) that may be used according to an illustrative embodiment of the disclosure. The computer server 101 may have a processor 103 for controlling overall operation of the server and its associated components, including RAM 105, ROM 107, input/output module 109, and memory 115.

I/O 109 may include a microphone, keypad, touch screen, and/or stylus through which a user of device 101 may provide input, and may also include one or more of a speaker for providing audio output and a video display device for providing textual, audiovisual and/or graphical output. Software may be stored within memory 115 and/or storage to provide instructions to processor 103 for enabling server 101 to perform various functions. For example, memory 115 may store software used by the server 101, such as an operating system 117, application programs 119, and an associated database 121. Alternatively, some or all of server 101 computer executable instructions may be embodied in hardware or firmware (not shown).

The server 101 may operate in a networked environment supporting connections to one or more remote computers, such as terminals 141 and 151. The terminals 141 and 151 may be personal computers or servers that include many or all of the elements described above relative to the server 101. The network connections depicted in FIG. 1 include a local area network (LAN) 125 and a wide area network (WAN) 129, but may also include other networks. When used in a LAN networking environment, the computer 101 is connected to the LAN 125 through a network interface or adapter 123. When used in a WAN networking environment, the server 101 may include a modem 127 or other means for establishing communications over the WAN 129, such as the Internet 131. It will be appreciated that the network connections shown are illustrative and other means of establishing a communications link between the computers may be used. The existence of any of various well-known protocols such as TCP/IP, Ethernet, FTP, HTTP and the like is presumed, and the system can be operated in a client-server configuration.

Additionally, an application program 119 used by the server 101 according to an illustrative embodiment of the disclosure may include computer executable instructions for invoking user functionality related to communication, such as email, short message service (SMS), and voice input and speech recognition applications.

Computing device 101 and/or terminals 141 or 151 may also be mobile terminals including various other components, such as a battery, speaker, and antennas (not shown).

The disclosure is operational with numerous other general purpose or special purpose computing system environments or configurations. Examples of well known computing systems, environments, and/or configurations that may be suitable for use with the disclosure include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The disclosure may be described in the general context of computer-executable instructions, such as program modules, being executed by a computer. Generally, program modules include routines, programs, objects, components, data structures, etc. that perform particular tasks or implement particular abstract data types. The disclosure may also be practiced in distributed computing environments where tasks are performed by remote processing devices that are linked through a communications network. In a distributed computing environment, program modules may be located in both local and remote computer storage media including memory storage devices.

Figure 2:
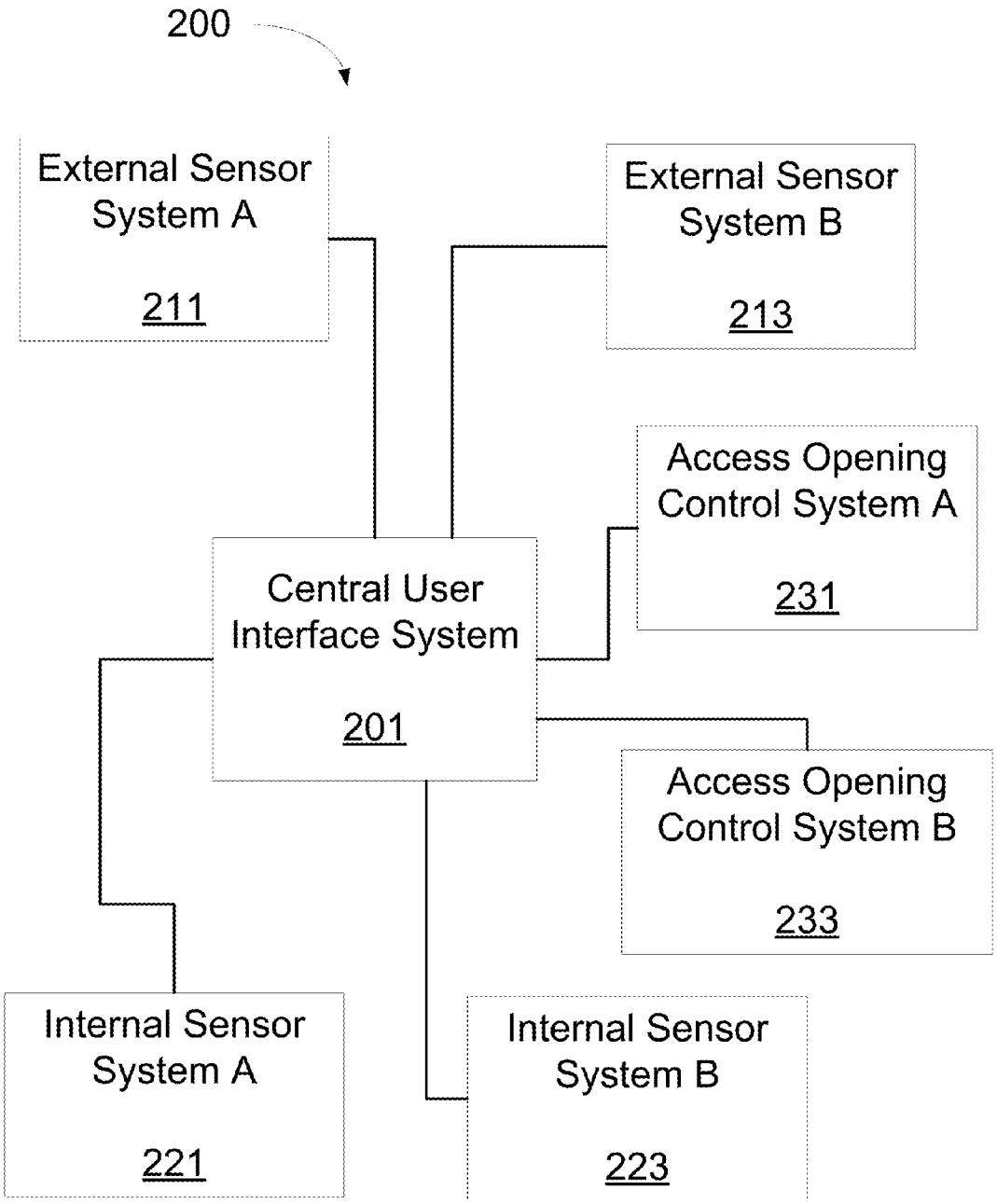
FIG. 2 illustrates a schematic diagram of a system for capturing and processing external sensor measurements and utilizing the same for adjusting access openings in accordance with one of more features described herein.

FIG. 2 illustrates a schematic diagram of a system 200 for capturing and processing external sensor measurements and utilizing the same for adjusting access openings in accordance with one of more features described herein. System 200 includes a central user interface system 201. Central user interface system 201 may be a computer such as described in FIG. 1, configured to receive data from one or more external sensor systems A 211 and/or B 213 and internal sensor systems A 221 and/or B 223, process the received data to calculate the dew point, and output the processed data onto a display screen and/or speakers. In one or more examples, the central user interface system 201 further may be configured to output instructions to one or more access opening control systems A 231 and/or B 233 where the instructions specify opening or closing an access opening between an indoor environment and an outdoor environment. Still further the instructions may include a length of time for opening or closing the access opening.

As described in more detail below, central user interface 201 may be configured to wirelessly receive data from one or more external sensor systems A 211 and/or B 213. The received data is representative of some type of measurement data captured by the external sensor system, such as external sensor system A 211. For example, the external sensor system A 211 may determine and/or directly measure the outdoor air temperature and/or outdoor air humidity at a home of a user. Data representative of the determined and/or measured temperature and/or humidity, such as 62.5° F. and/or 54% relative humidity, may be wirelessly transmitted to the central user interface system 201. This received data may then be processed by the central user interface system 201 and ultimately outputted in some manner onto a display screen and/or speakers.

Central user interface 201 also may be configured to receive user inputs associated with a desired configuration for the output to a display screen. As described in more detail below, measured data from one or more external sensor and/or internal sensor systems may be processed for output in any of a number of manners for a user onto a display screen. For example, a user may desire to see a trend of the indoor temperature and/or humidity in a home during a 24-hour period. As such, the output to a display screen may be configured to show a graph of the indoor temperature and/or relative humidity percentage per specific time period, such as every 10 minutes or every hour. Central user interface 201 may be configured to permit a user to include a number of different outputs on a display screen in any of a number of different manners.

Central user interface system 201 may be configured to operate in conjunction with a digital photo frame, such as an LCD digital photo frame. Central user interface system 201 may be configured to operatively connect with the digital photo frame to output any of the display features described herein on the display screen of the digital photo frame. In an alternative embodiment, central user system 201 may be manufactured as part of a digital photo frame and not removable. As an attachment that may be removed, central user interface system 201 may be adaptable to any of a number of different manufactured digital photo frames.

FIG. 2 shows a number of external sensor systems A 211 and B 213 operatively connected to central user interface 201. More or less than the two shown may be included. Each of external sensor systems A 211 and B 213 may be configured to determine and/or measure outdoor temperature and/or humidity. For example, for use in a house, external sensor system A 211 may include a thermometer able to measure an outdoor temperature at the house. The external sensor system A 211 may directly measure the outdoor temperature and/or outdoor humidity and/or receive information from another device. This data then may be wirelessly transmitted to the central user interface system 201. As described herein, central user interface system 201 may be an aesthetic digital photo frame in the house of the user. The external sensor system A 211 may be physically outside the house and wireless transmission may be needed to transmit the data to the central user interface system 201.

Each of external sensor systems A 211 and B 213 may be configured for operation with any of a number of different devices. An external sensor system may be configured to operate with respect to a specific protocol for capturing data from an associated device. A different external sensor system may be configured to operate with a different protocol for a different associated device. Each external sensor system A 211 and B 213, as described herein, may include a connection system for specific operation with an associated device. Still further, external sensor system may be configured for operation with two or more associated devices concurrently. For example, if a thermometer and a humidity measurement device at the house of a user are physically close to each other, one external sensor system may be operatively connected to each of the associated thermometer and humidity measurement device to capture temperature data and relative humidity data for transmission to a central user interface system 201.

FIG. 2 also shows a number of internal sensor systems A 221 and B 223 operatively connected to central user interface 201. More or less than the two shown may be included. Each of internal sensor systems A 221 and B 223 may be configured to determine and/or measure indoor temperature and/or humidity. For example, for use in a house, internal sensor system A 221 may include a thermometer able to measure an indoor temperature at the house. The internal sensor system A 221 may directly measure the indoor temperature and/or indoor humidity and/or receive information from another device. This data then may be wirelessly transmitted to the central user interface system 201. The internal sensor system A 221 may be physically inside the house at a location separate from the central user interface system 201 and wireless transmission may be needed to transmit the data to the central user interface system 201. In other embodiments, the internal sensor system may be integrated within the central user interface system 201.

Each of internal sensor systems A 221 and B 223 may be configured for operation with any of a number of different devices. An internal sensor system may be configured to operate with respect to a specific protocol for capturing data from an associated device. A different internal sensor system may be configured to operate with a different protocol for a different associated device. Each internal sensor system A 221 and B 223, as described herein, may include a connection system for specific operation with an associated device. Still further, internal sensor system may be configured for operation with two or more associated devices concurrently. For example, if a thermometer and a humidity measurement device in the house of a user are physically close to each other, one external sensor system may be operatively connected to each of the associated thermometer and humidity measurement device to capture temperature data and relative humidity data for transmission to a central user interface system 201.

FIG. 2 also shows a number of access opening control systems A 231 and B 233 operatively connected to central user interface 201. More or less than the two shown may be included. Each of access opening control systems A 231 and B 233 may be configured for adjusting an access opening between an indoor environment, such as inside a house, and an outdoor environment, such as outside the house. For example, for use in a house, access opening control system A 231 may transmit instructions for opening or closing one or more windows of a house. The access opening control system A 231 may directly open and/or close an access opening, such as a window of a house, and/or receive instruct another device to perform the same. The access opening control system A 231 may be physically located at a window of the house at a location separate from the central user interface system 201 and wireless transmission may be needed to transmit data between the central user interface system 201 and the access opening control system A 231. In other embodiments, the access opening control system may be integrated within the central user interface system 201.

Each of access opening control systems A 231 and B 233 may be configured for operation with any of a number of different access openings. An access opening control system may be configured to operate with respect to all access opening, such as all windows, of a house, a subset of all access openings, such as all windows on the first floor of a three story house, or a single access opening, such as one window in the house. Each access opening control system A 231 and B 233, as described herein, may include a connection system for specific operation with an access opening.

Figure 3:
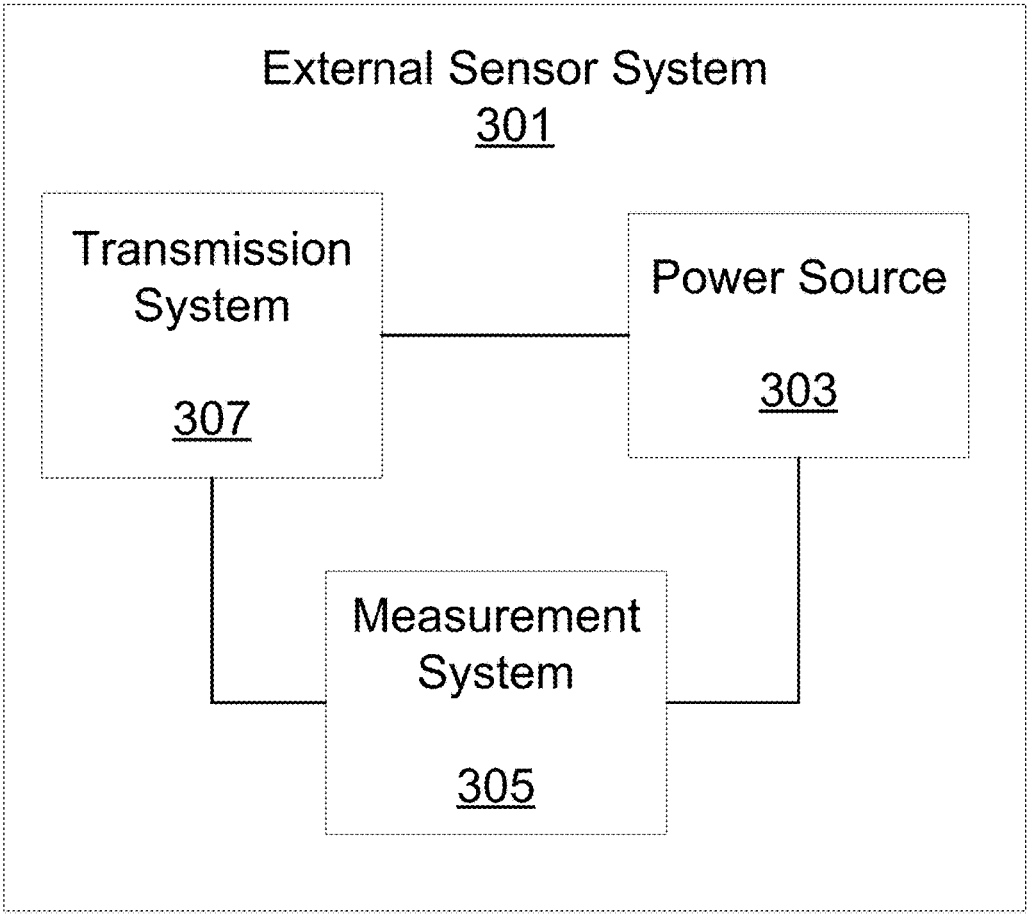
FIG. 3 illustrates a schematic diagram of an external sensor system configured for measuring outdoor temperature and humidity in accordance with one of more features described herein.

FIG. 3 illustrates a schematic diagram of an external sensor system 301 configured for measuring outdoor temperature and humidity in accordance with one of more features described herein. External sensor system 301 may be any of external sensor system A 211 and/or B 213 described in FIG. 2. External sensor system 301 includes a power source 303. Power source 303 may be any of a number of circuitries for supplying power for operation of one or more components of external sensor system 301.

For example, power source 303 may include batteries and wiring for supplying power to the other components of the external sensor system 301. In another example, power source 303 may include a solar panel for capturing light and storing energy from the captured light for use in powering one or more components of the external sensor system 301. In still another example, power source 303 may include circuitry to allow for receiving power from an external source. Any of a number of different technologies may be included for operationally connecting to power from an external source.

External sensor system 301 also may include a transmission system 307. Transmission system 307 may include components for transmitting data wirelessly to a central user interface system, such as central user interface system 201 in FIG. 2. Transmission system 307 may be configured to transmit data periodically, such as every 5 minutes or every hour, or may be configured to continuously transmit data to a central user interface system. Transmission system 307 may be configured to change modes of operation, such as changing time periods for transmission or from periodic transmission to continuous transmission. Data transmission from transmission system 307 may be wireless to allow for transmission of data from further distances without the need for direct wiring.

External sensor system 301 is shown to include a measurement system 305. Measurement system 305 may include components for determining and/or directly measuring outdoor temperature and/or relative humidity for eventual transmission to a central user interface. Measurement system 305 may include circuitry to capture outdoor temperature and/or relative humidity readings and/or perform its own measurement of outdoor temperature and/or relative humidity to process and store such data. For example, measurement system 305 may be configured to periodically determine and/or measure outdoor temperature and/or relative humidity data and process the data to generate a trend of outdoor temperature and/or relative humidity. Measurement system 305 may be configured to provide data of outdoor temperature and/or relative humidity over a 4 hour period from 6 am-8 am and 8 pm-10 pm when occupancy at the house may be greatest during a day. Any of a number of different measurement algorithms and/or calculations may be performed by measurement system 305 to provide a desired variable for eventual transmission to a central user interface.

External sensor system 301 also may include a connection system. A connection system may be any of a number of various manners for connecting the external sensor system 301 to an associated device, such as a thermometer. A thermometer may include a generic output connection offered by a manufacturer of the thermometer. The generic output connection may have a specific physical connection. A connection system may be configured for use with the output connection of the thermometer.

Figure 4:
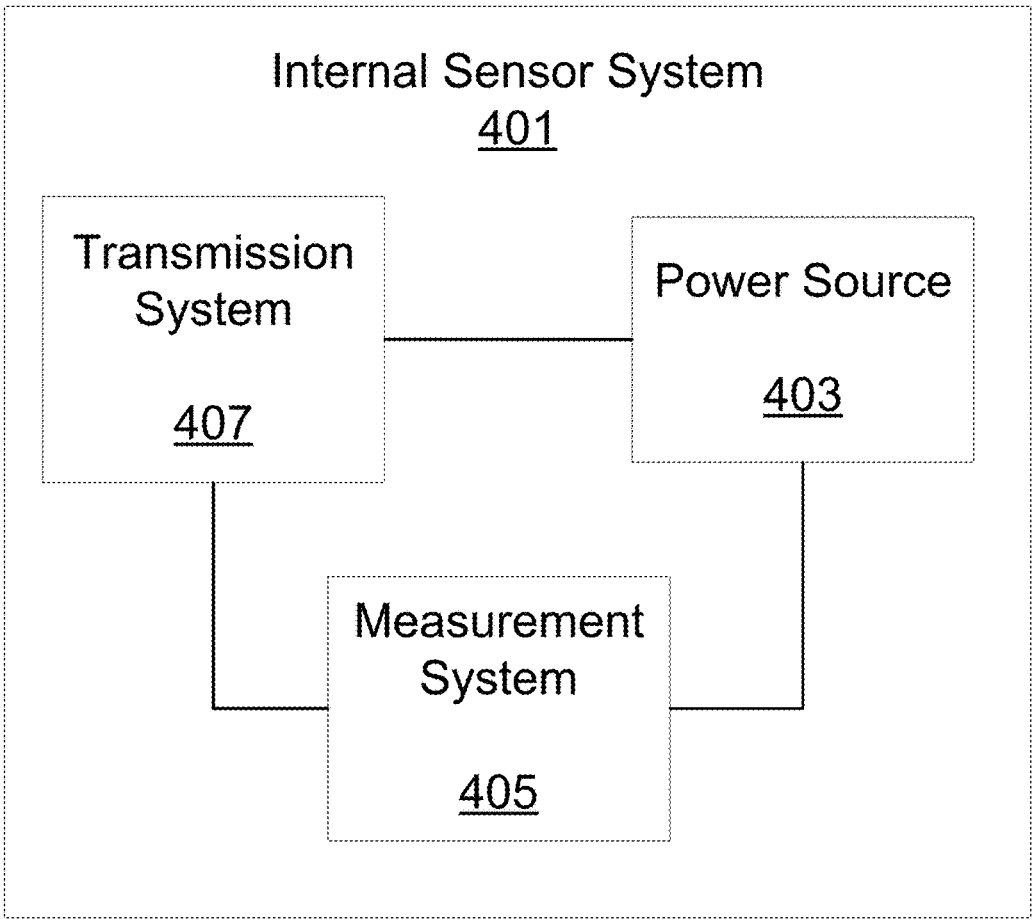
FIG. 4 illustrates a schematic diagram of an internal sensor system configured for measuring indoor temperature and humidity in accordance with one of more features described herein.

FIG. 4 illustrates a schematic diagram of an internal sensor system 401 configured for measuring indoor temperature and humidity in accordance with one of more features described herein. Internal sensor system 401 may be any of internal sensor system A 221 and/or B 223 described in FIG. 2. Internal sensor system 401 includes a power source 403. Like 303 in FIG. 3, power source 403 may be any of a number of circuitries for supplying power for operation of one or more components of internal sensor system 401.

For example, power source 403 may include batteries and wiring for supplying power to the other components of the internal sensor system 401. In another example, power source 403 may include a solar panel for capturing light and storing energy from the captured light for use in powering one or more components of the internal sensor system 401. In still another example, power source 403 may include circuitry to allow for receiving power from an external source. Any of a number of different technologies may be included for operationally connecting to power from an external source.

Internal sensor system 401 also may include a transmission system 407. Transmission system 407 may include components for transmitting data wirelessly to a central user interface system, such as central user interface system 201 in FIG. 2. Transmission system 407 may be configured to transmit data periodically, such as every 5 minutes or every hour, or may be configured to continuously transmit data to a central user interface system. Transmission system 407 may be configured to change modes of operation, such as changing time periods for transmission or from periodic transmission to continuous transmission. Data transmission from transmission system 407 may be wireless to allow for transmission of data from further distances without the need for direct wiring.

Internal sensor system 401 is shown to include a measurement system 405. Measurement system 405 may include components for determining and/or directly measuring indoor temperature and/or relative humidity for eventual transmission to a central user interface. Measurement system 405 may include circuitry to capture indoor temperature and/or relative humidity readings and/or perform its own measurement of indoor temperature and/or relative humidity to process and store such data. For example, measurement system 405 may be configured to periodically determine and/or measure indoor temperature and/or relative humidity data and process the data to generate a trend of indoor temperature and/or relative humidity. Measurement system 405 may be configured to provide data of indoor temperature and/or relative humidity over a 4 hour period from 6 am-8 am and 8 pm-10 pm when occupancy at the house may be greatest during a day. Any of a number of different measurement algorithms and/or calculations may be performed by measurement system 405 to provide a desired variable for eventual transmission to a central user interface.

Internal sensor system 401 also may include a connection system. A connection system may be any of a number of various manners for connecting the internal sensor system 401 to an associated device, such as a thermometer. A thermometer may include a generic output connection offered by a manufacturer of the thermometer. The generic output connection may have a specific physical connection. A connection system may be configured for use with the output connection of the thermometer.

Figure 5:
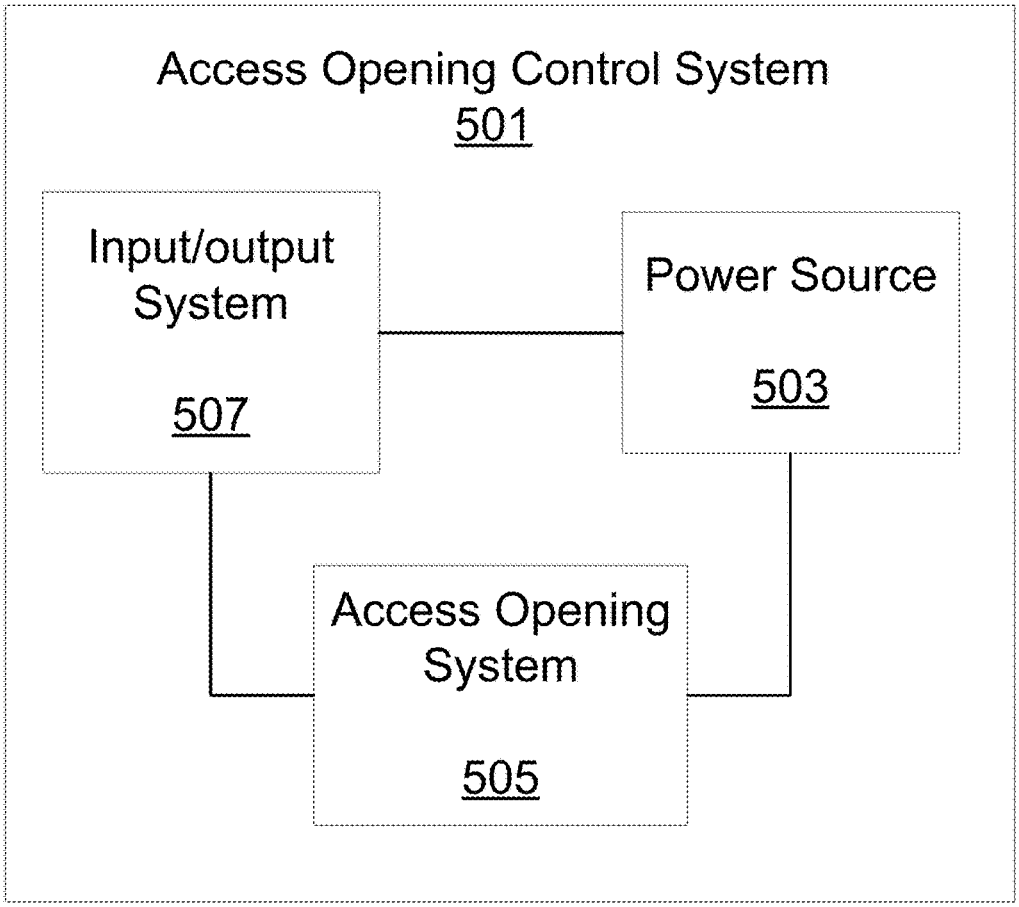
FIG. 5 illustrates a schematic diagram of an access opening control system configured for adjusting an access opening between an indoor environment and an outdoor environment in accordance with one of more features described herein.

FIG. 5 illustrates a schematic diagram of an access opening control system 501 configured for adjusting an access opening between an indoor environment and an outdoor environment in accordance with one of more features described herein. Access opening control system 501 may be any of access opening control system A 231 and/or B 233 described in FIG. 2. Access opening control system 501 includes a power source 503. Like 303 and 403 in FIG. 3, power source 503 may be any of a number of circuitries for supplying power for operation of one or more components of access opening control system 501.

For example, power source 503 may include batteries and wiring for supplying power to the other components of the access opening control system 501. In another example, power source 503 may include a solar panel for capturing light and storing energy from the captured light for use in powering one or more components of the access opening control system 501. In still another example, power source 503 may include circuitry to allow for receiving power from an external source. Any of a number of different technologies may be included for operationally connecting to power from an external source.

Access opening control system 501 also may include an input/output system 507. Input/output system 507 may include components for receiving data wirelessly from a central user interface system, such as central user interface system 201 in FIG. 2. Input/output system 507 may be configured to receive data periodically, such as every 5 minutes or every hour, or may be configured to continuously receive data from a central user interface system. Input/output system 507 may be configured to change modes of operation, such as changing time periods for receiving or from periodic receipt to continuous receipt. Data reception at input/out system 507 may be wireless to allow for receipt of data from further distances without the need for direct wiring.

Access opening control system 501 is shown to include an access opening system 505. Access opening system 505 may include components for instructing another device to and/or directly opening or closing one or more access openings, such as a window. Access opening system 505 may include circuitry to open a window of a house and/or to close a window of a house. Access opening system 505 may be configured to open an access opening for a specific amount of time and/or until an instruction to close the access opening is received.

Access opening control system 501 also may include a connection system. A connection system may be any of a number of various manners for connecting the access opening control system 501 to an associated device, such as a lock for a window. A lock for a window may include a generic input connection offered by a manufacturer of the lock, such as an expected data field input for unlocking A connection system may be configured for use with the input connection of the thermometer.

Figure 6:
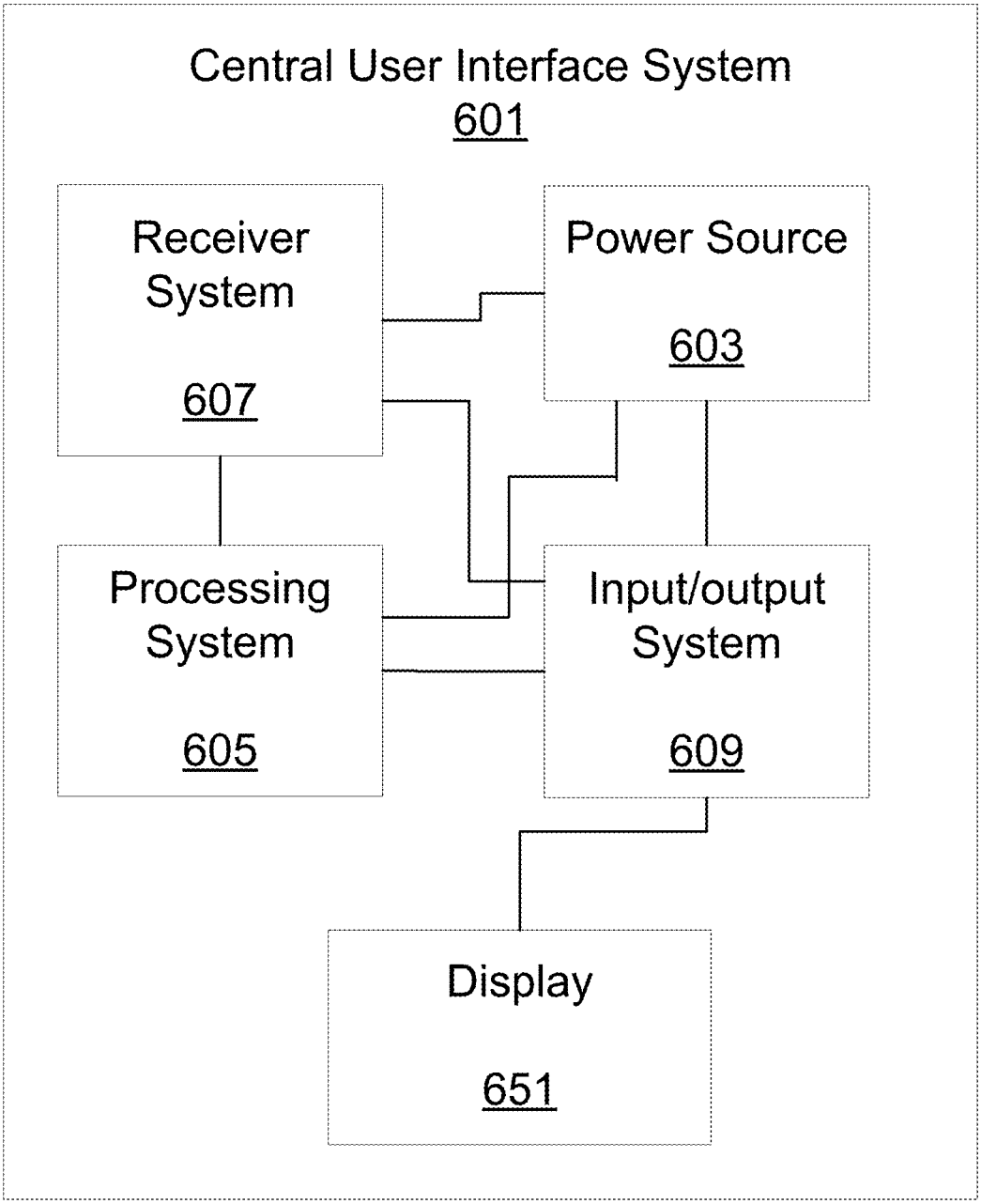
FIG. 6 illustrates a schematic diagram of a central user interface system in accordance with one of more features described herein.

FIG. 6 illustrates a schematic diagram of a central user interface system 601 in accordance with one of more features described herein. Central user interface system 601 may be central user interface system 201 described in FIG. 2. Central user interface system 601 includes a power source 603. Power source 603 may be any of a number of circuitries for supplying power for operation of one or more components of central user interface system 601.

For example, power source 603 may include batteries and wiring for supplying power to the other components of the central user interface system 601. In another example, power source 603 may include a solar panel for capturing light and storing energy from the captured light for use in powering one or more components of the central user interface system 601. In still another example, power source 603 may include circuitry to allow for receiving power from an external source. Any of a number of different technologies may be included for operationally connecting to power from an external source.

Central user interface system 601 also may include a receiver system 607. Receiver system 607 may include components for receiving data wirelessly from one or more external and/or internal sensor systems, such as external sensor 301 in FIG. 3 and internal sensor 401 in FIG. 4. Receiver system 607 may be configured to receive data periodically, such as every 5 minutes or every hour, or may be configured to continuously receive data from one or more external and/or internal sensor systems. Receiver system 607 may be configured to change modes of operation, such as changing time periods for reception or from periodic reception to continuous reception. Data reception by receiver system 607 may be wireless to allow for reception of data from further distances without the need for direct wiring.

Central user interface system 601 is shown to include a processing system 605. Processing system 605 may include components for processing data received from one or more external and/or internal sensor systems. In the example of FIG. 2 with two different external sensor systems A 221 and B 213 and two different internal sensor systems A 221 and B 223 wirelessly transmitting data to central user interface system 201, a processing system of central user interface 201 may be configured to process all of the data received to output in a desired manner to a display 651. For example, processing system may be configured to receive data and generate a recommendation to a user for opening and/or closing one or more access openings of a house. Processing system 605 may be configured to store data of a plurality of measurements over time, such as internal and/or external temperature, and then generate a visual graphic for output on display 651.

Processing system 605 may be preconfigured for specific operation and/or may be modified based upon one or more inputs received through input/output system 609. If display 651 is a touch screen display device, a user may enter desired variables to be shown. For example, if central user interface system 601 is configured to receive data wirelessly from five different external sensor systems but a user has entered a request to display only three of those measured data variables, processing system 605 may be configured to generate the desired output for display on display 651 for the three measured data variables while not displaying the other two.

Processing system 605 may be configured to take the measurement of the outdoor air temperature and outdoor relative humidity, such as from external sensor system 301 in FIG. 3. Processing system 605 further may be configured to take the measurement of the indoor air temperature and indoor relative humidity, such as from internal sensor system 401 in FIG. 4. Processing system 605 may calculate the dew point, and using the current indoor temperature, processing system 605 may determine whether bringing in the outside air to the indoor environment would make the indoor climate more wet, more dry, or have no change. Bringing in the outside air to indoors may mean opening one or more windows for a limited time and then to close the window, so that the indoor climate changes but the indoor temperature would not change.

Once the estimated new indoor humidity is calculated, processing system 605 may compare the estimated new indoor humidity to an air comfort table. The air comfort table may be predefined and/or may be configured to a user's desired amounts. Based on the comparison to the table, processing system 605 may output a recommendation to display 651 on whether to open the one or more windows or not to open the one or more windows. In addition, processing system 605 may recommend a specific amount of time that the one or more windows should be opened. For example, the processing system 605 may determine to open all of the windows of the house for three total minutes. After the three minute time period, a recommendation to close the windows may be displayed or the windows may be automatically closed.

In one example, the measured relative humidity indoors may be 28% and the estimated new indoor relative humidity if an access opening is opened is 29%, processing system 605 may output a notice of "no change," meaning a recommendation to not open the corresponding access opening. In comparison to a comfort chart for the relative humidity, increasing the indoor relative humidity from 28% to 29% may not be desired as it may be considered a negligible change in the climate indoors.

In another example, the measured relative humidity indoors may be 28% and the estimated new indoor relative humidity if an access opening is opened is 22%, processing system 605 may output a notice of "more dry." In comparison to a comfort chart for the relative humidity, lowering the indoor relative humidity from 28% to 22% may not be desired as it may be determined to be too dry indoors already. Thus a recommendation to not open, i.e., keep closed, the corresponding access opening may be displayed.

In still another example, the measured relative humidity indoors may be 22% and the estimated new indoor relative humidity if an access opening is opened is 29%, processing system 605 may output a notice of "more wet." In comparison to a comfort chart for the relative humidity, increasing the indoor relative humidity from 22% to 29% may be desired as it may be determined to be too dry indoors. Thus a recommendation to open the corresponding access opening may be displayed.

Figure 7:
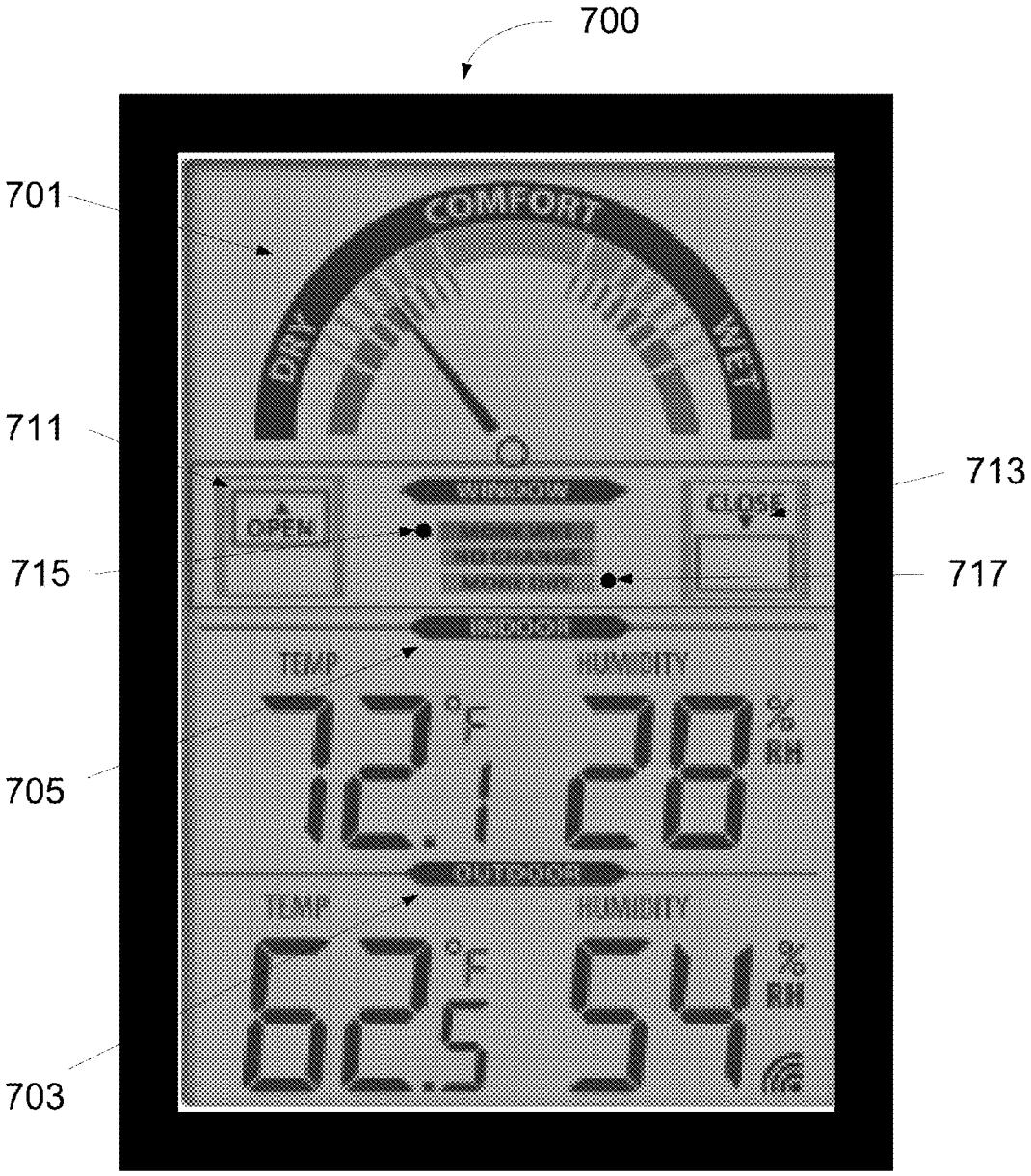
FIGS. 7-9 illustrate examples of a central user interface system with various user interfaces in accordance with one of more features described herein.
Figure 8:
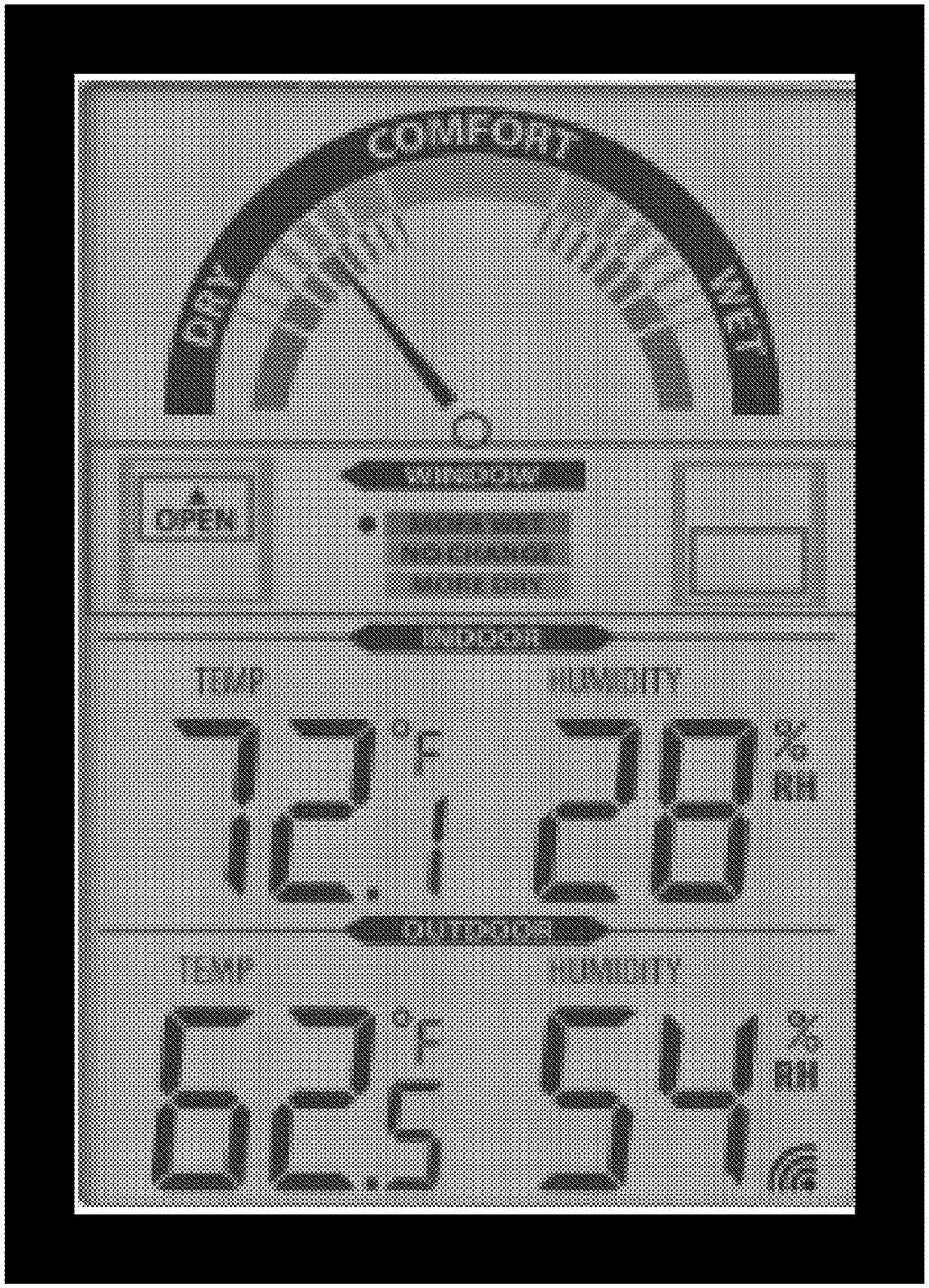
Figure 9:
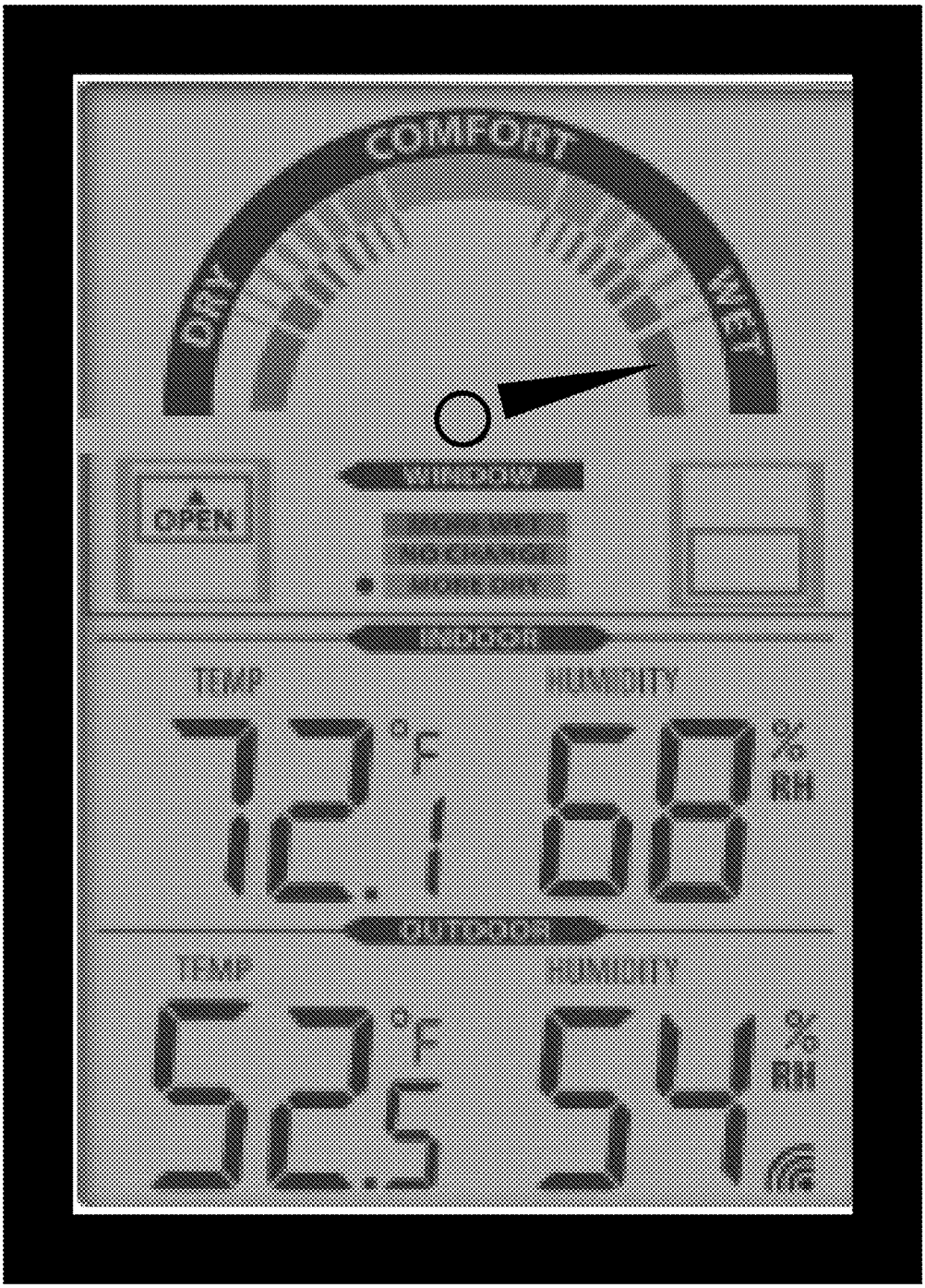

As shown with respect to FIGS. 7-9, icons may be provided to give a user useful information. A recommendation if the user should have her windows open or closed may be displayed. Similarly, an indication of what will happen to her indoor relative humidity if the windows are opened, e.g., "more wet," "more dry," "no change" may be displayed to advise if the outdoor air will be more humid, less humid, or negligibly more or less humid than the indoor air after it has been let in the house and heated or cooled to the indoor temperature. Still other icons may be displayed to recommend turning on and/or off a humidifier and/or dehumidifier, such as if the indoor air is uncomfortably dry or moist and it would not help to open a window.

Returning back to FIG. 6, central user interface system 601 also is shown to include an input/output system 609. Input/output system 609 may be any of a number of various manners for providing output to and receiving input from an associated device, such as display 651. In one example, display 651 may be a touch screen display where a user can make contact with a portion of the display to represent a desired input. In such an example, input/output system 609 may be configured to receive inputs from the touch screen display 651 for processing by the processing system 605 and output to display 651 desired output data. As such, input/output system allows a user to create a specific desired output to a display 651. Input/output system 609 further may include other forms of input and output. For example, any of a number of switches, slide bars, input buttons, output connection ports, speakers, and other input/output devices may be utilized. Input/output system 609 allows a user to create a desired output on display 651.

Input/output system 609 further may be configured to output instructions to an access opening control system, such as access opening control system 501 in FIG. 5. Such output instructions may include an instruction to open or close one or more access opening associated with the access opening control system. Still further, such instruction may include a predetermined amount of time for opening or closing the access opening. For example, such instructions may be to open all windows for a period of five minutes and then to close the windows after that time. An access opening control system, such as access opening control system 501 in FIG. 5, may receive such instructions and implement the same accordingly. Input/output system may receive the instructions to be outputted from processing system 605.

Processing system 605 may determine, based upon the outdoor and indoor temperatures and relative humidities that, if all access openings, such as windows, of the house are opened for the five minutes, and then closed back again, the relative humidity in the house would increase to a desired comfort level. Again, such a comfort level may be defined and/or set by a user of the house or predefined without house user input.

FIGS. 7-9 illustrate examples of a central user interface system with various user interfaces 700, 800, and 900 in accordance with one of more features described herein. FIG. 7 illustrates a system where one or more features described herein may be included within or operatively connected to a digital photo frame. FIG. 7 illustrates an example user interface 700 that may be a default configuration or may be a configuration desired by a user of the system. FIG. 7 includes a comfort table 701 with an arrow showing a current comfort level of the indoor relative humidity as somewhat dry and outside of the comfortable area of the table. Such a visual indicator may be included to allow a user to see the current comfort level of the indoor climate in an easy to read manner.

In this example, data received from one or more external sensor systems is displayed on a display screen as the current outdoor temperature and relative humidity 703. The data shown as the current outdoor temperature and relative humidity 703 may be received from an external sensor system, such as external sensor system 301 in FIG. 3. Other data received from one or more internal sensor systems is displayed on the display screen as the current indoor temperature and relative humidity 705. The data shown as the current indoor temperature and relative humidity 705 may be received from an internal sensor system, such as internal sensor system 401 in FIG. 4.

In the example of FIG. 7, two different access opening recommendations 711 and 713 may be shown for recommendation purposes. The two different access opening recommendations may be one each for two access openings or may one each for a plurality of access openings, such as the access opening recommendation 711 for the access openings on the first floor of a house and the access opening recommendation 713 for the access opening on the second floor of the house. In the example of FIG. 7, the access opening recommendation 711 is to open its associated one or more access openings while the access opening recommendation 713 is to close its associated one or more access openings. The examples of FIGS. 8 and 9 may be for one access opening recommendation with the left side for a recommendation of open and a right side for a recommendation of closed.

Indicator icons 715 and 717 may be shown to advise a user as to the outcome should the recommendation be implemented. If the access openings associated with the access opening recommendation 711 are opened, the resulting new indoor relative humidity will be more wet. Since the current level indicated on the comfort table 701 is somewhat dry, such a desired result of more wet is desired and should or may be implemented. Alternatively, if the access openings associated with the access opening recommendation 713 are closed, the resulting new indoor relative humidity will be more dry. Since the current level indicated on the comfort table 701 is somewhat dry, such a desired result of more dry likely is not desired and should not or may not be implemented. With the one or more recommendations in hand, a user may open and/or close the access openings or the system automatically may open and/or close the access openings to achieve a result for the indoor relative humidity level to be closer to the comfort area of the comfort table 701.

One or more components of the central user interface system may exist in different devices. For example, in one embodiment, a standard digital photo frame already may include a receiver system, an input/output system, a processing system, and a power source. A user may insert an attachment into the standard digital photo frame for display of data in a desired manner. Such an attachment may be a small device connected to a memory card slot, such as an SD card slot, of the digital photo frame. The small device may create certain jpeg images with whatever information a user desires to see, including history and graphs. The small attachment device may include appropriate circuitry and components for operating the display of the digital photo frame to display a desired output.

While the disclosure has been described with respect to specific examples including presently preferred modes of carrying out the methods described herein, those skilled in the art will appreciate that there are numerous variations and permutations of the above described systems and techniques. Thus, the spirit and scope of the disclosure should be construed broadly.

What is claimed is:

1. A method comprising:

receiving, by a computing device, first data from at least one external sensor system, the first data from the external sensor system comprising external climate data;

receiving, by the computing device, second data from at least one internal sensor system, the second data comprising an indoor air temperature and an indoor air humidity;

calculating, by the computing device, a dew point for an indoor environment based upon the first data from the at least one external sensor system and the second data from the at least one internal sensor system;

outputting, to a display of the computing device, a graphical indication of an indoor environment climate based upon the dew point, wherein the graphical indication represents a graphical comfort level of the indoor environment climate relative to a range of indoor environment climates; and outputting, to the display of the computing device, an access opening recommendation based on the indoor environment climate and an outdoor environment climate, the outdoor environment climate being based on the first data from the at least one external sensor system.

2. The method of claim 1, wherein at least a portion of the graphical comfort level of the indoor environment climate is based on a defined user input.

3. The method of claim 2, wherein the graphical comfort level includes a user comfort level based, at least in part, on a defined comfort setting of a user, and wherein the access opening recommendation is further based on the user comfort level.

4. The method of claim 1, wherein the display of the computing device is a digital photo frame.

5. The method of claim 1, further comprising:

determining whether to change at least one access opening from one of: an open state to a closed state and a closed state to an open state, wherein the access opening recommendation is outputted responsive to determining to change the at least one access opening.

6. The method of claim 5, further comprising determining a period of time to change the at least one access opening from one of: the open state to the closed state and the closed state to the open state, wherein the determining the period of time is based upon the dew point for the indoor environment.

7. The method of claim 5, further comprising sending, from the computing device, an instruction to an access opening control system associated with the at least one access opening to change the at least one access opening from one of: the open state to the closed state and the closed state to the open state.

8. The method of claim 7, further comprising:

determining a period of time to change the at least one access opening from one of: the open state to the closed state and the closed state to the open state; and sending, from the computing device, an instruction to the access opening control system associated with the at least one access opening to change the at least one access opening from one of: the open state to the closed state and the closed state to the open state for the period of time.

9. The method of claim 8, wherein the determined time period is based upon the dew point for the indoor environment.

10. An apparatus comprising:

a receiver system configured to:

receive first data from at least one external sensor system, the first data from the external sensor system comprising outdoor climate data;

receive second data from at least one internal sensor system, the second data from the internal sensor system comprising an indoor air temperature and an indoor air humidity;

a processing system configured to:

calculate a dew point for an indoor environment based upon the first data from the at least one external sensor system and the second data from the at least one internal sensor system;

calculate, based on the indoor air temperature and the dew point, an estimated indoor humidity if a first access opening is opened for a first amount of time;

compare the estimated indoor humidity to an air comfort chart; and generate, based on the comparing, an access opening recommendation; and a display configured to output a first graphical indication of an indoor environment climate based upon the dew point and a second graphical indication of the access opening recommendation, wherein the first graphical indication represents a graphical comfort level of the indoor environment climate relative to a range of indoor environment climates.

11. The apparatus of claim 10, wherein at least a portion of the graphical comfort level of the indoor environment climate is based on a defined user input.

12. The apparatus of claim 11, wherein the first graphical indication includes a user comfort level based, at least in part, on a defined comfort setting of a user, and wherein the access opening recommendation is further based on the user comfort level.

13. The apparatus of claim 10, wherein the processing system is further configured to:

generate an access opening recommendation to change the first access opening from a closed state to an open state responsive to determining that the estimated indoor humidity is above a first value stored in the air comfort chart.

14. The apparatus of claim 13, wherein the processing system is further configured to determine a period of time to change the first access opening from one of: the open state to the closed state and the closed state to the open state.

15. The apparatus of claim 14, wherein the determined time period is based upon the dew point for the indoor environment.

16. The apparatus of claim 13, further comprising an input/output system configured to send an instruction to an access opening control system associated with the first access opening to change the first access opening from one of: the open state to the closed state and the closed state to the open state.

17. The apparatus of claim 16, wherein the processing system is further configured to determine a period of time to change the first access opening from one of: the open state to the closed state and the closed state to the open state, and wherein the input/output system is further configured to send an instruction to the access opening control system associated with the first access opening to change the first access opening from one of: the open state to the closed state and the closed state to the open state for the determined time period.

18. A method comprising:

receiving, by a computing device, outdoor climate data from at least one external sensor system;

receiving, by the computing device, data from at least one internal sensor system, the data comprising an indoor air temperature and an indoor air humidity;

calculating, by the computing device, a dew point for an indoor environment based upon the outdoor climate data from the at least one external sensor system and the data from the at least one internal sensor system;

calculating, based on the indoor air temperature and the dew point, an estimated indoor humidity if a first access opening is opened for a first amount of time;

comparing the estimated indoor humidity to an air comfort chart;

generating, based on the comparing, an access opening recommendation, the access opening recommendation comprising an indication of whether to change the first access opening from one of: an open state to a closed state and a closed state to an open state; and outputting, to a display of the computing device, the access opening recommendation and a graphical indication of an indoor environment climate based upon the dew point.

19. The method of claim 18, further comprising receiving, at the computing device, a user selection to change the first access opening from one of: an open state to a closed state and a closed state to an open state.

20. The method of claim 18, further comprising changing the first access opening from one of: an open state to a closed state and a closed state to an open state, responsive to determining to change the first access opening.

* * * * *